US005340006A

United States Patent [19]

Li

[11] Patent Number: 5,340,006

[45] Date of Patent: Aug. 23, 1994

[54] HEAD-SUPPORTED CUP HOLDER

[76] Inventor: Tianhou Li, Lafitte Village, Apt. B101, New Orleans, La. 70148

[21] Appl. No.: 26,357

[22] Filed: Mar. 4, 1993

[51] Int. Cl.[5] ..... A45F 3/18

[52] U.S. Cl. ..... 224/148; 224/181; 224/197; 224/251

[58] Field of Search ..... 224/148, 181, 197, 200, 224/249, 251, 270

[56] References Cited

U.S. PATENT DOCUMENTS

| | | | |
|---|---|---|---|
| 2,550,554 | 4/1951 | Griffin | 224/148 X |
| 2,907,539 | 10/1959 | Vardan | 224/148 X |
| 4,739,905 | 4/1988 | Nelson | 224/148 X |
| 4,754,903 | 7/1988 | Dennis | 224/148 |
| 4,972,982 | 11/1990 | Harbour | 224/270 |
| 4,993,611 | 2/1991 | Longo | 224/148 |
| 5,148,950 | 9/1992 | Hosaka | 224/148 X |

FOREIGN PATENT DOCUMENTS

| | | | |
|---|---|---|---|
| 170441 | 10/1929 | United Kingdom | 224/181 |

*Primary Examiner*—Renee S. Luebke

*Attorney, Agent, or Firm*—Henderson & Sturm

[57] ABSTRACT

A head-supported drink holder apparatus (10) for supporting a beverage receptacle (100) at a desired generally horizontal distance from a user's mouth; wherein, the apparatus comprises a pair of support members (20) strapped to the user's head and having apertured outwardly projecting foot elements (23) adapted to rotatably support an outer ring element (34) which in turn rotatably supports an inner ring element (31) which is dimensioned to releasably support the beverage receptacle (100).

8 Claims, 2 Drawing Sheets

HEAD-SUPPORTED CUP HOLDER

TECHNICAL FIELD

The present invention relates to body supported drink holder in general; and, in particular to body supported drink holder having a pivoting capability.

As can be seen by reference to the following U.S. Pat. Nos. 4,739,905; 2,907,539; 4,754,903; and 4,993,611; the prior art is replete with myriad and diverse body supported drink holders.

While all of the aforementioned prior art constructions are more than adequate for the basic purpose and function for which they have been specifically designed, these patented constructions are uniformly deficient in a number of significant areas.

To begin with none of the cited references allows the position of the supported drink to be adjusted in a horizontal plane relative to the user's mouth.

In addition only one of the cited references employs the user's head as a primary support surface; and, furthermore none of the patented devices allows for pivoted movement of the supported beverage receptacle about more than one axis.

As a consequence of the foregoing situation, there has existed a longstanding need for a new type of head supported beverage holder; wherein, the beverage holder is adjustable in a horizontal plane towards and away from the user's mouth as well as being provided with two independent and perpendicular axes of rotation; and, the provision of such a construction is a stated objective of the present invention.

DISCLOSURE OF THE INVENTION

Briefly stated, the head-supported drink holder that forms the basis of the present invention comprises in general: a pair of primary support units provided with a plurality of cooperating strap members for attaching the primary support units to the user's head in a secure fashion; and, a beverage receptacle retention unit which is operatively suspended between the pair of primary support units and adapted to rotate about two perpendicularly aligned generally horizontally disposed axes.

As will be explained in greater detail further on in the specification, the head-supported drink holder of this invention is designed to be secured in a surrounding fashion with respect to the back and sides of the user's head to provide a generally stable support for a beverage receptacle.

In addition, the beverage receptacle retention unit is provided with a dual pivoted ring support arrangement; wherein, the outer ring allows the supported beverage receptacle to pivot towards and away from the user, while the inner ring allows the supported beverage receptacle to pivot from side to side.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
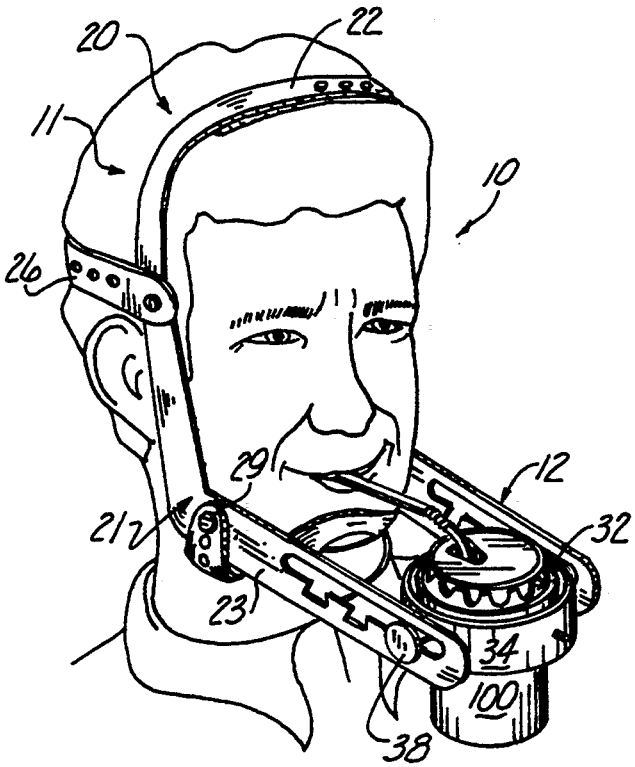
FIG. 1 is a perspective view of the head-supported drink holder that forms the basis of the present invention in use.

As can be seen by reference to the drawings, and in particular to FIG. 1, the head-supported drink holder apparatus that forms the basis of the present invention is designated generally by the reference numeral (10). The apparatus (10) comprises in general a pair of primary head engaging support units (11) and a beverage receptacle holder unit (12). These units will now be described in seriatim fashion.

Figure 3:
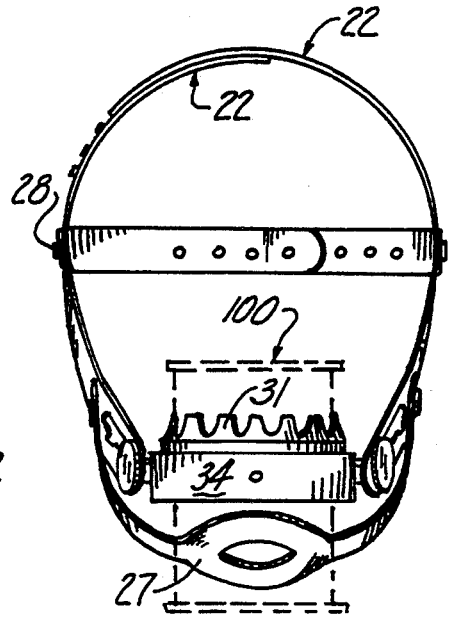
FIG. 3 is a front elevation view thereof.
Figure 2:
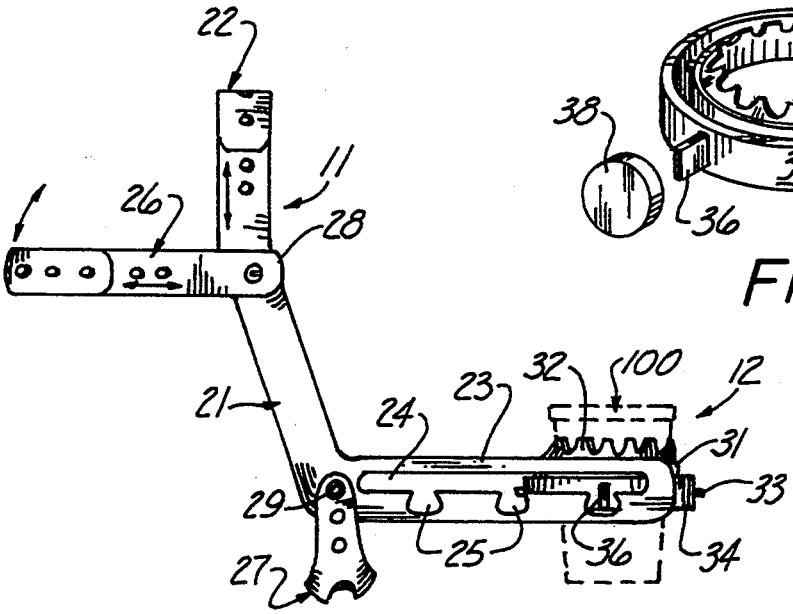
FIG. 2 is a side elevation view thereof.

As can best be seen by reference to FIGS. 1 thru 3, each of the primary support units (11) comprises an elongated support member designated generally as (20) and having a generally flat, rigid L-shaped lower portion (21) and a generally curved relatively flexible upper portion (22).

In addition the foot element (23) of each generally rigid L-shaped lower portion (21) of the support member (20) is provided with an elongated slot (24) having a plurality of downwardly depending spaced recesses (25) formed therein.

Figure 5:
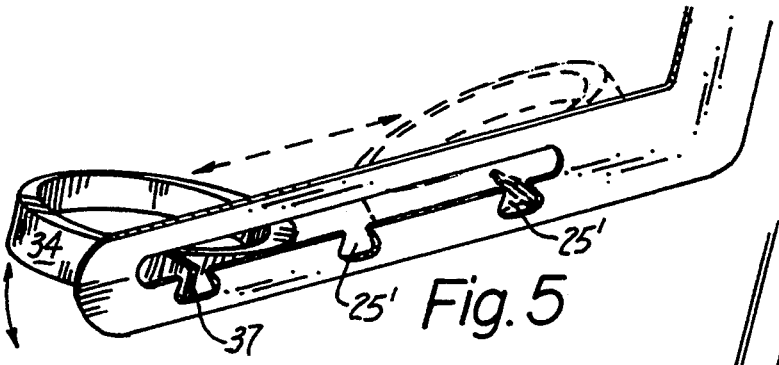
FIG. 5 is an isolated perspective view of one version of the outer ring of the holder unit suspended in specially contoured grooves.
Figure 6:
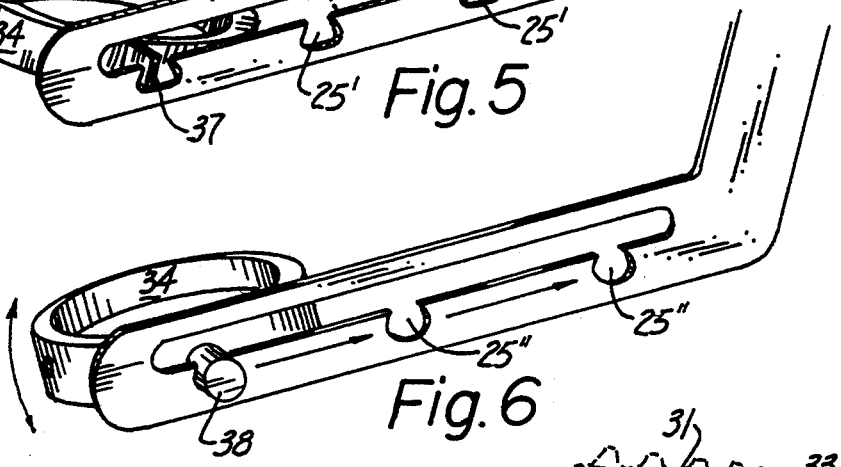
FIG. 6 is an isolated perspective view of another version of the outer ring of the holder unit suspended in different specially contoured grooves.

As shown in FIG. 5 the spaced recesses (25) may be provided with a generally bow shaped configuration having flat sides (25'); and, as shown in FIG. 6, the spaced recesses may have a generally circular configuration having rounded sides (25"); wherein, the purpose and function of these particular recess configurations (25') and (25") will be explained in greater detail further on in the specification.

Referring back to FIGS. 1 thru 3, it can be seen that each of the support members (20) are provided with a cooperating pair of strap members (26) and an additional strap member (27); wherein the pair of cooperating strap members (26) encircles the back of the user's head, and the strap member (27) encircles the user's chin. Furthermore, the generally flexible upper portion (22) of the support members (20) is designed to function as a third pair of cooperating strap members which encircle the top of the user's head.

It should further be noted that the pair of strap members (26) which encircle the back of the user's head are hingedly secured at the top of the leg element (28) of the generally rigid lower portion (21) of the support members (20); while the chin engaging strap members (27) is hingedly secured as at (29) at the juncture of the leg (28) and foot (23) elements of the support members (20).

In this manner the apertured foot elements (23) of both support members (20) are maintained in a generally rigid outwardly directed parallel fashion, for reasons that will be explained presently.

Figure 4:
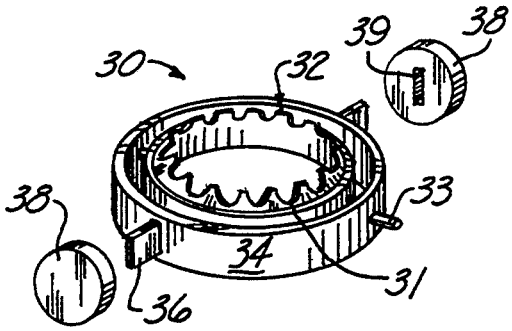
FIG. 4 is an isolated perspective view of one version of the beverage receptacle holder unit.
Figure 7:
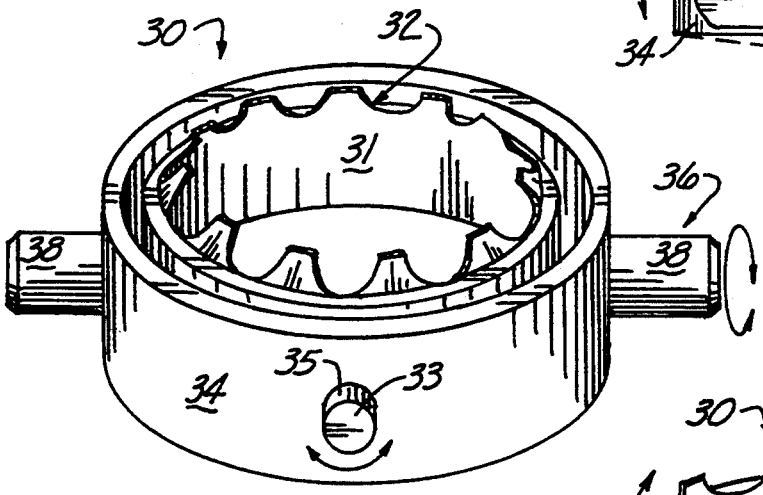
FIG. 7 is an isolated perspective view of a second version of the beverage holder unit.
Figure 9:
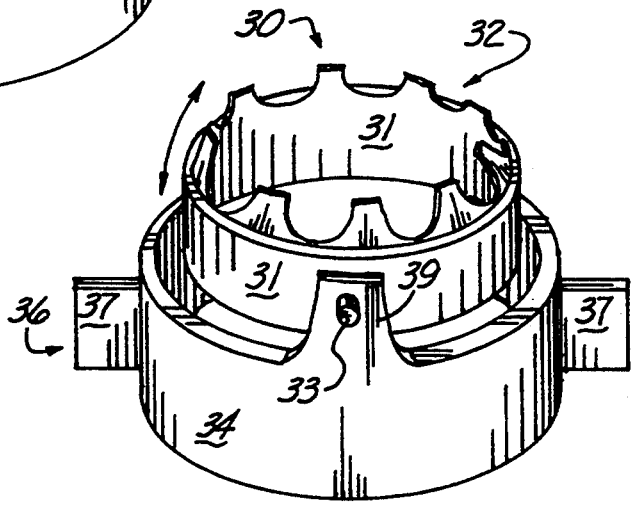

Turning now to FIGS. 4, 7 and 9 it can be seen that the beverage holder comprises a dual axis double ringed receptacle capture member (30) including an inner ring element (31) provided with an inwardly and upwardly projecting generally resilient scalloped skirt member (32); wherein, the inner ring element (31) is rotatably disposed around a first axle element (33).

In addition, the beverage holder receptacle unit (12) further comprises an outer ring element (34) provided with suitably dimensioned opposed apertures (35) for rotatably receiving the first axle element (33) of the inner ring element; and, wherein, the outer ring element (34) is provided with a second axle element (36) which is perpendicularly offset from the first axle element (33) of the inner ring element (31); so that the inner (31) and outer (34) ring elements may pivot about two independent axes.

In the first version of the preferred embodiment depicted in FIG. 4, the first and second axle elements (33) and (36) are disposed in the same general plane; wherein, the second axle element (36) comprises a pair of vertically aligned tabs (37) which are dimensioned to be received for limited rotational movement in the recesses (25) of the embodiment depicted in FIGS. 2 and 5.

In addition, it should be noted that the sides of the tabs (37) are designed and intended to engage the flat sides (25') of the bow shaped recess (25) to limit the arc of rotation of the outer ring element (34); such as when the device (10) is to be employed in a moving vehicle, or the like.

Furthermore, as can clearly be seen by reference to FIG. 4, the outer ends of the second axle elements (36) are provided with enlarged cap elements (38) having suitably dimensioned and configured recesses (39) to captively receive the second axle elements (36) relative to the foot elements (23) of each support member (20).

Figure 8:
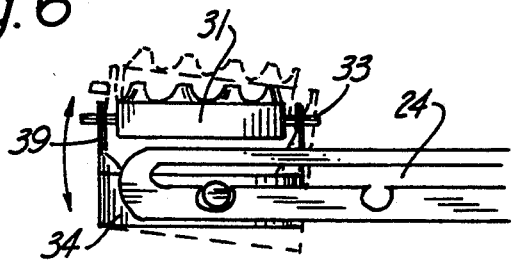
FIG. 8 is a side elevation view depicting the forward and rearward tilting action provided by the beverage holder unit; and, FIG. 9 is an isolated perspective view of a third version of the beverage holder unit.

In the second version of the preferred embodiment depicted in FIGS. 8 and 9, the first and second axle elements (33) and (36) are disposed in two different planes; wherein, the first axle element (33) is rotatably supported in a pair of opposed upwardly projecting ears (39) formed on top of the outer ring element (34).

In yet another version of the preferred embodiment the first and second axle elements (33) and (36) are disposed in the same general plane; wherein, the second axle element (33) comprises a pair of cylindrical stubs (38) which are dimensioned to be rotatably received in the embodiments depicted in FIGS. 6 and 8.

By now it should be appreciated that the head-supported drink holder apparatus (10) that forms the basis of the present invention captively retains a beverage receptacle (100) with the resilient skirt member (32) of the inner ring element (31); wherein, the inner ring element (31) pivots on an axis that is disposed perpendicular to the axis of rotation of the outer ring element (34) which is adjustably suspended between the two support members (20); and, whose position relative to the two support members (20) may be varied to locate the beverage receptacle a desired distance from the user's mouth.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A head-supported drink holder apparatus for supporting a beverage receptacle at a selected generally horizontal distance from a user's mouth; wherein, the apparatus comprises:

a pair of head engaging support units wherein each support unit comprises a support member having a generally rigid L-shaped lower portion, including a leg element and a foot element; wherein, each foot element is provided with an elongated aperture provided with a plurality of recesses, strap means for securing the support members to the user's head; and, a beverage receptacle holder unit including an inner ring element dimensioned to receive a beverage receptacle and having a first axle element; and, an outer ring element dimensioned to receive said first axle element of the inner ring element and provided with a second axle element disposed generally perpendicular to said first axle element; wherein, said second axle element is dimensioned to be received in opposed recesses in said support members.

2. The apparatus as in claim 1; wherein, said first axle element and said second axle element are disposed in the same generally horizontal plane.

3. The apparatus as in claim 1; wherein, said second axle element is disposed in a different generally horizontal plane relative to said first axle element.

4. The apparatus as in claim 1; wherein, said inner ring element is provided with an inwardly directed resilient skirt dimensioned to releasably engage the periphery of said beverage receptacle.

5. The apparatus as in claim 1; wherein, the upper portion of the support members comprise a plurality of cooperating strap members which connect the support members together over the top of the user's head.

6. The apparatus as in claim 5; wherein, the strap means comprise a first strap members connected to the support members and dimensioned to surround the user's chin.

7. The apparatus as in claim 6; wherein, the strap means further comprise a second pair of strap members connected to the support members and dimensioned to surround the back of the user's head.

8. The apparatus as in claim 1, further including means associated with both said plurality of recesses and second axle element for limiting the relative movement of said second axle element in said recesses.

* * * * *